US005598793A

United States Patent [19]

Lopez, Jr.

[11] Patent Number: 5,598,793

[45] Date of Patent: Feb. 4, 1997

[54] ATM ANTI-THEFT DEVICE

[76] Inventor: Martin Lopez, Jr., 1913 Muny Vista Ct., Alton, Ill. 62002

[21] Appl. No.: 661,364

[22] Filed: Jun. 11, 1996

Related U.S. Application Data

[63] Continuation-in-part of Ser. No. 408,932, Mar. 22, 1995, Pat. No. 5,537,938, which is a continuation-in-part of Ser. No. 79,098, Jun. 17, 1993, abandoned.

[51] Int. Cl.[6] ..... E05G 1/14

[52] U.S. Cl. ..... 109/25; 109/29; 109/32; 109/34; 109/36

[58] Field of Search ..... 109/24.1, 20, 31, 109/25, 29–34, 36, 37; 239/274, 289

[56] References Cited

U.S. PATENT DOCUMENTS

| | | | |
|---|---|---|---|
| 720,330 | 2/1903 | Craig | 109/32 |
| 2,203,675 | 6/1940 | Davis | 109/29 |
| 3,344,757 | 10/1967 | Touyet | 109/25 |
| 3,730,110 | 5/1973 | Peters | 109/25 |
| 4,363,279 | 12/1982 | Johansson | 109/29 |
| 4,391,203 | 7/1983 | Millar | 109/25 |
| 4,425,853 | 1/1984 | McGregor et al. | 109/25 |
| 4,607,579 | 8/1986 | Stenild | 109/25 |
| 4,712,489 | 12/1987 | Levavasseur | 109/25 |
| 4,799,435 | 1/1989 | Boutroy | 109/25 |
| 4,823,010 | 4/1989 | Kornbrekke et al. | 250/341 |
| 4,841,752 | 6/1989 | Fletcher | 109/20 |
| 4,975,680 | 12/1990 | Fogle, Jr. | 340/571 |
| 5,156,272 | 10/1992 | Bouchard et al. | 206/495.1 |
| 5,311,166 | 5/1994 | Frye | 340/541 |
| 5,537,938 | 7/1996 | Lopez, Jr. | 109/29 X |

OTHER PUBLICATIONS

Alemite Lubrication Fittings, Catalog 880, Jun. 1986.
Lincoln Accessories, p. 21.
Diebold, 1992.
Ansul—Halon Fire Suppression Systems.
Ansul—Halon 1301 Fire Suppression Systems—Installation, Operation, Recharge, Inspection and Maintenance Manual.
Ansul—Halon 1301 Fire Suppression Systems—Field Fill Station Operation Manual.

*Primary Examiner*—Lloyd A. Gall
*Attorney, Agent, or Firm*—Herzog, Crebs & McGhee

[57] ABSTRACT

An anti-theft device for Automated Teller Machines (ATMs) provides for the blurring or defacing of banknotes which are stored within ATM banknote cassettes/containers within the ATM upon a breach of security of the ATM, the breach of security being either a break-in attempt or the attempted removal of the entire ATM from its location. An indelible dye or ink, stored under pressure within a tank internal to the ATM unit, is caused to be released into a distribution manifold, which is integral with the banknote cassette and in communication with the interior thereof, upon receipt of an actuating signal. The actuating signal is preferably developed by an electrical device which triggers the release of the ink into the cassette. In one embodiment, connection and disconnection of the distribution manifold to the tank occurs automatically without user interface when cassettes are changed. In another embodiment, the distribution manifold is separate from the cassette. When ink enters the manifold fluid pressure extends a set of nozzles to carry ink to bores drilled in the cassettes, thus requiring only minimal modification of the cassette. A swiveling extension is added to the end of the pick up tube in the pressurized ink tank. When the machine, and therefore the tank, is tilted, the swiveling extension helps extract the maximum quantity of ink possible from the tank.

12 Claims, 10 Drawing Sheets

ATM ANTI-THEFT DEVICE

CROSS-REFERENCE TO RELATED APPLICATIONS

The present application is a Continuation-In-Part of patent application Ser. No. 08/408,932 filed Mar. 22, 1995 entitled "ATM ANTI-THEFT DEVICE" by the present inventor, now U.S. Pat. No. 5,537,938, which in turn is a Continuation-In-Part of patent application Ser. No. 08/079,098 filed Jun. 17, 1993, now abandoned, entitled "ATM ANTI-THEFT DEVICE" by the present inventor,

BACKGROUND OF THE INVENTION

The present invention relates to anti-theft devices for Automated Teller Machines and, more particularly to a device for defacing by blurring or staining, valuable documents such as bank notes or bills in Automated Teller Machines in the event of unauthorized entry or theft.

It has been estimated that in 1991, approximately 8,527 Automated Teller Machines (ATMs) were shipped to companies in the United States while an additional 60,994 were shipped overseas, with the number to surely increase.

With the proliferation of ATMs has come a concurrent rise in the attempted and committed thefts of currency from ATMs since the currency within is not guarded. ATMs are subject to attack by burglars or thefts seeking to extract the currency therefrom. Because ATMs are enclosed in a steel safe-like structure that is extremely difficult to penetrate in a short period of time, therefore the phenomena is occurring of the burglar actually extracting the ATM as a whole. After the burglar has extracted the unit, the ATM is then taken from the premises to another, preferably remote location, where the thief has the time to break into the ATM unit and extract the money contained therein.

Various solutions have been proposed in the prior art to cope with such situations wherein money and/or documents are stored within enclosed containers. One such solution involves the use of pyrotechnical means in which an explosive is utilized to inject a staining liquid into the money/document container. However, such pyrotechnical solutions may be dangerous for persons in the vicinity of the system and, in the case of ATMs which utilize sophisticated machinery and electronics, the use of pyrotechnical means is not desirable in that such may destroy the sophisticated equipment of the ATM and the user.

Other known methods are complex mechanical solutions aimed at partially destroying the bank notes by perforating or mutilating the same. These complex systems generally require complicated machinery and a fair amount of power.

Recently, chemical solutions have been devised which generally consist of using discoloring means such as smoke generators for blurring or staining the documents within the container. These products, however, are likely to impair the environment, and in particular the electronic components in the ATM.

Another solution is found in U.S. Pat. No. 5,156,272 issued Oct. 20, 1992 to Bouchard, et al. Essentially Bouchard utilizes a sponge having one or several frangible pockets, phials, ducts or the like. In one embodiment, a piston-like tank pushes an indelible dye into the ducts of the sponge which are then broken or ruptured such that the dye will be delivered to the sponge. The sponge distributes the dye to the documents for blurring the same. Thus, the sponge is an integral part of Bouchard in that the sponge is utilized to distribute the dye over all of the documents within the container. However, such an apparatus as Bouchard utilizing a sponge tends to delay the application of the ink onto the documents as the sponge must first soak up the dye and then when saturated, allow the dye to permeate the container and blur the documents.

It is thus an object of the present invention to overcome the deficiencies in the prior art and provide a safe, quick and effective defacing of documents within an ATM upon an unauthorized breach thereof.

SUMMARY OF THE INVENTION

The present invention provides an apparatus for marking banknotes contained within a banknote cassette in an Automated Teller Machine (ATM) upon a breach of security of the ATM. The apparatus comprises a pressurized tank, an indelible liquid ink stored within the pressurized tank, and a manifold operatively associated with the banknote cassette and in communication with the pressurized tank. The manifold provides a distribution path for the ink into the cassette in order for the ink to deface the banknotes upon release of the ink from the tank. Further provided is means for releasing the ink from the pressurized tank upon a breach of security of the ATM such that the ink is delivered under pressure to the banknotes via the manifold to thereby deface the banknotes.

According to one aspect of the present invention, the releasing means comprises an actuator adapted to release the contents of the pressurized tank upon receipt of an actuating signal, and means in communication with the actuator for generating an actuating signal upon a breach of security.

The system is preferably electrical having an electrical input supplied by a normal external power source, typically A.C., or by a battery backup should the normal external power source fail or be interrupted. Various signal generating or input devices may be utilized to trigger the actuator. Control circuitry monitors the various input devices and relays the actuation signal to the tank actuator.

The actuator is generally a pyrotechnic or initiator device and the means for generating an actuating signal may be a mercury switch array, a photoelectric eye, a pendulum tilt switch, a contact or pressure switch, or a gravity ball tilt mechanism. The mercury switch array generates the actuating signal when the ATM is moved in any plane from horizontal. The photoelectric eye provides the actuating signal when a photobeam is interrupted as the entrant crosses the beam. The pendulum tilt also provides a signal upon tilting the ATM from the horizontal plane. The contact switch provides its signal upon release of pressure thereon, while the gravity ball tilt mechanism provides a signal upon shaking or rocking.

According to another aspect of the present invention, the apparatus for defacing banknotes contained within a banknote cassette in an Automated Teller Machine (ATM) upon a breach of security of the ATM, by releasing an indelible ink or dye under pressure into the banknote cassette includes a power cartridge as an initiator disposed adjacent to a non-fragmenting design rupture disc as the tank valve. The power cartridge is mounted in a cap of the pressurized tank containing the indelible ink. Rupture of the disc releases the ink into a distribution manifold operatively associated with the banknote cassette. The distribution manifold is coupled on the intake side to the tank. Upon application of pressure from the ink, the output nozzles of the distribution manifold extend until the outer tips of the nozzles contact pre-drilled holes in the banknote cassette, thereby providing fluid communication from the distribution manifold to the banknote cassette, and in turn from the tank to the banknote cassette so the ink may deface the notes.

According to another aspect, when the banknote cassette is removed from the ATM, the connector automatically releases from the distribution manifold, and when the banknote cassette is returned to the ATM, the connector automatically couples to the distribution manifold.

According to another aspect of the invention, the distribution manifold is installed in close proximity to the money cassettes rather than on it. This obviates the necessity of attaching a manifold directly to the cassette. The manifold includes a plurality of extendable nozzles. The money cassettes have holes drilled in a wall thereof, each hole corresponding to a nozzle on the manifold. When the ink is discharged, the pressure from the ink forces each nozzle to extend, such that the tip of the nozzle abuts the corresponding hole in the banknote cassette. The ink then flows into the cassette, thereby defacing the notes. This embodiment has the advantage of not requiring a modification of the banknote cassettes beyond drilling the holes therein. A single distribution manifold is all that is needed, rather than a plurality of distribution manifolds, one for each cassette, thus saving money and installation time. Only holes are provided in the cassettes. This embodiment also allows the same defacing apparatus with banknote cassettes of varying specifications. The head of the extendable nozzles may either be piston-shaped or funnel-shaped ink guides.

According to another aspect of the invention, bushings are inserted in the holes drilled in the banknote cassette to allow for better fluid communication between the nozzles and their corresponding holes.

According to yet another aspect of the invention, the internal pick up tube for the ink tank is fitted with a special swivel ending. The swivel ending is an elbow-shaped extension of the pick up tube that rests at the bottom of the inside of the ink tank. When the ATM is tilted from the horizontal plane the ink will not be entirely extractable from the pressurized tank. When a tank with a standard pick up tube is tilted 90 degrees, only one half of the ink is extractable. With the special ending on the pick up tube, the effective reach of the pick up tube is not only extended, but due to the swivel action, effective reach of the pick up tube is always extended toward the ink if tank is tilted from its normal orientation.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
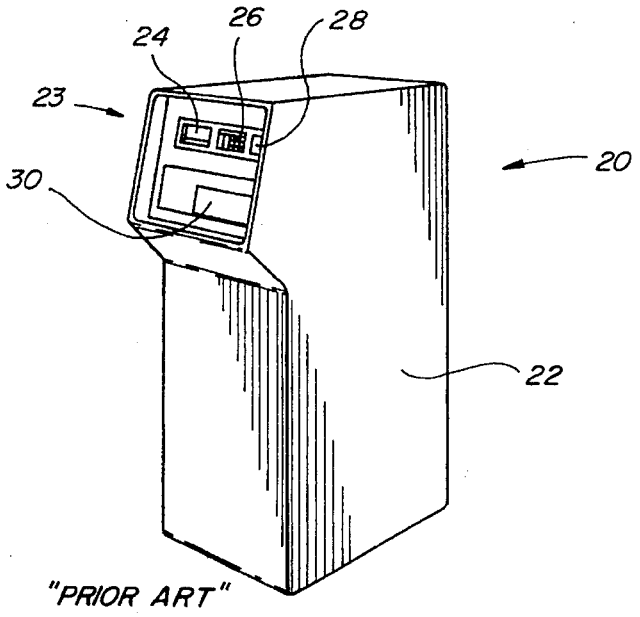
FIG. 1 is an elevational view of a typical ATM.

Referring to FIG. 1 there is shown a typical stand-alone Automated Teller Machine (ATM) 20. At the outset it should be noted that the present invention is applicable to all types of ATMs and not only stand-alone units, however, a stand-alone ATM will be shown in the drawings. ATM 20 includes a housing 22 which encloses a modular electronic/mechanical unit 23, being the heart and brains of the ATM. Unit 23 includes a screen 24 for displaying information and choices to the user, an alpha/numeric keypad 26, a card access 28, and a money withdrawal/deposit port 30. Unit 23 is enclosed within a steel lined casing (not shown) that encloses all of the necessary hardware and software to operate the ATM. Generally, ATMs include a heating and cooling source for maintaining the working components, software, and hardware in working condition in all environments.

Figure 2:
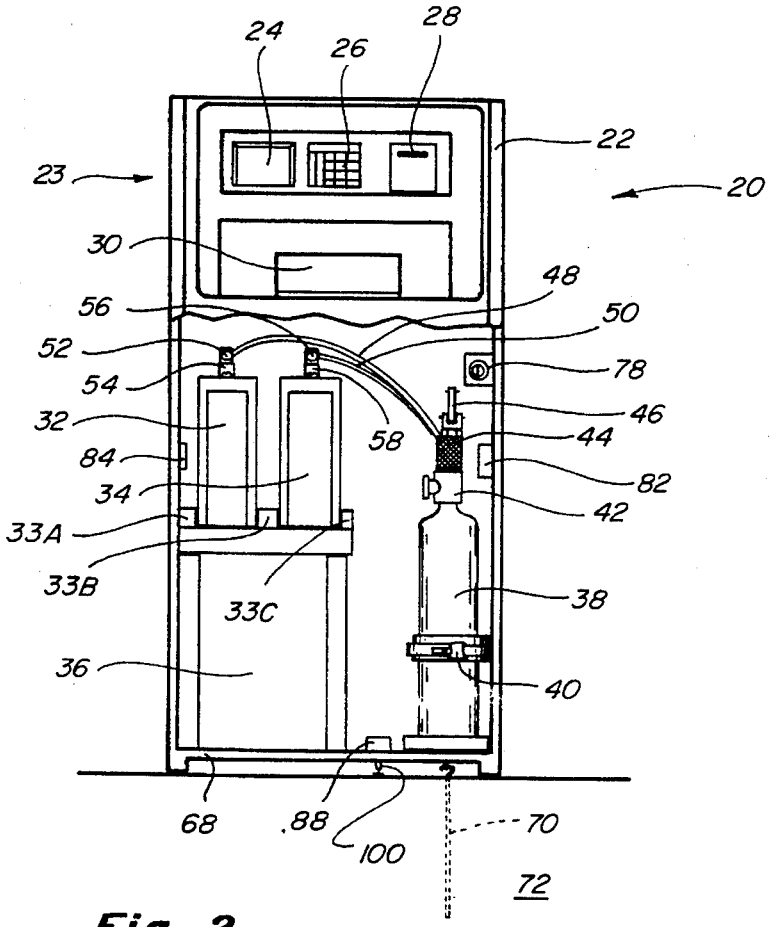
FIG. 2 is a front partial cut-away view of the improved ATM of FIG. 1.

Referring now to FIG. 2, ATM 20 is shown in a cutaway view having two money cassettes 32 and 34, that are typical in the ATM industry, such as, for example, those shown in the Diebold catalogue submitted with the Information Disclosure Statement filed concurrently herewith. Although ATM 20 is shown having two money cassettes it should be understood that only one cassette or more than two cassettes may be accommodated in the ATM and are contemplated as within the scope of the present invention. Such cassettes may also be of any size and shape as the principles and operation of the present invention are equally applicable. Typically, cassettes 32 and 34 are for separate denominations of bills to dispense to the customer, say for example 20's and 10's in order to accommodate various cash amount requests. However, in some instances, ATMs dispense only one type of currency and thus cassettes 32, 34 may contain the same bill denomination. Cassettes 32 and 34 are aligned within ATM 20 via tracks 33*a*, 33*b*, 33*c* which rest on a stand 36. Tracks 33*a–c* guide cassettes 32, 34 because of the close tolerance needed between the cassette and the money dispensing mechanism, generally a vacuum type mechanism, for pulling the money from the cassette and delivering it to port 30. Cassettes 32 and 34 thus slide back and forth generally parallel with the floor of ATM 20 to allow replacement thereof when the money within the cassettes runs out.

In accordance with an aspect of the present invention, a pressurized tank 38 is disposed within housing 22 secured therein by a tank bracket 40. Tank 38 may be of any suitable type made to hold its contents at various pressures as, for example, in the range of 300–1000 psi. Here, tank 38 may be a 5 lb. Ansul® 1301 Halon tank. Disposed on the top portion of tank 38 is a pressure valve 42 for releasing the contents of tank 38 upon activation thereof. Pressure valve 42 is preferably a valve of the differential piston-type which leads itself to various modes of actuation, e.g. electric, pneumatic, manual. The primary material of valve 42 is brass which makes the valve somewhat corrosion resistant.

Valve 42, in the example, made and tested by the inventor as described hereinbelow under the head "Example", is shown in the Ansul® Halon 1301 Fire Suppression Systems—Installation, Operation, Recharge, Inspection and Maintenance Manual submitted with the Information Disclosure Statement filed concurrently herewith. Tank pressure acting on chamber areas on either side of the piston produces a positive sealing force such that the contents of the tank under pressure remains therein. The same pressure is thus attained on both sides of the piston due to a small vent or bleed hole through the piston. A free floating ball (not shown) acting as a one-way check valve allows minute flow through the piston; however, at actuation, when there is a large pressure difference, flow is checked. Actuation is accomplished by venting the pressure from the upper chamber (not shown) through a vent valve (not shown) this venting is accomplished by using any type of actuator, as described hereinbelow. The pressure is vented from the upper chamber, then the downward force is eliminated allowing the pressure in the tank to force the piston totally out of the flow passage to release the contents therein.

Disposed on top of valve 42 is an actuator 44 for actuating valve 42 in order to release the contents of tank 38. Actuator 44 is a solenoid type actuator which is also manually actuatable. Actuator 44 includes a longitudinal piston therein which is actuatable by a solenoid to move longitudinally to release the valve in pressure valve 42. Thus, actuator 44 may be energized by an electric signal to cause the solenoid to open valve 42, and alternatively actuator 44 may be manually actuated to open valve 42. Disposed at the top of actuator 44 is a lever actuator 46 which in conjunction with a cable system described hereinbelow, provides the manual actuation for actuator 44 by manually moving a pin (not shown) to actuate pressure valve 42.

Coupled to valve 42 are two hoses 48 and 50 which terminate in buttonhead couplers 52 and 56 respectively. Alternatively, the hoses may be stainless steel lines or conduits rather than hoses. This is because it is preferable to fix the connectors and lines leading to the banknote cassettes for ease of removing and installing the cassettes. Buttonhead couplers 52 and 56 may, for example, be Lincoln type couplers model 80933, as shown in the Lincoln catalogue, page 21, submitted with the Information Disclosure Statement filed concurrently herewith. The buttonhead couplers 52, 56 couple hoses 48 and 50 to manifolds 54 and 58 respectively on cassettes 32 and 34 such that the contents of tank 38 is in fluid communication with the cassettes 32, 34.

Figure 3:
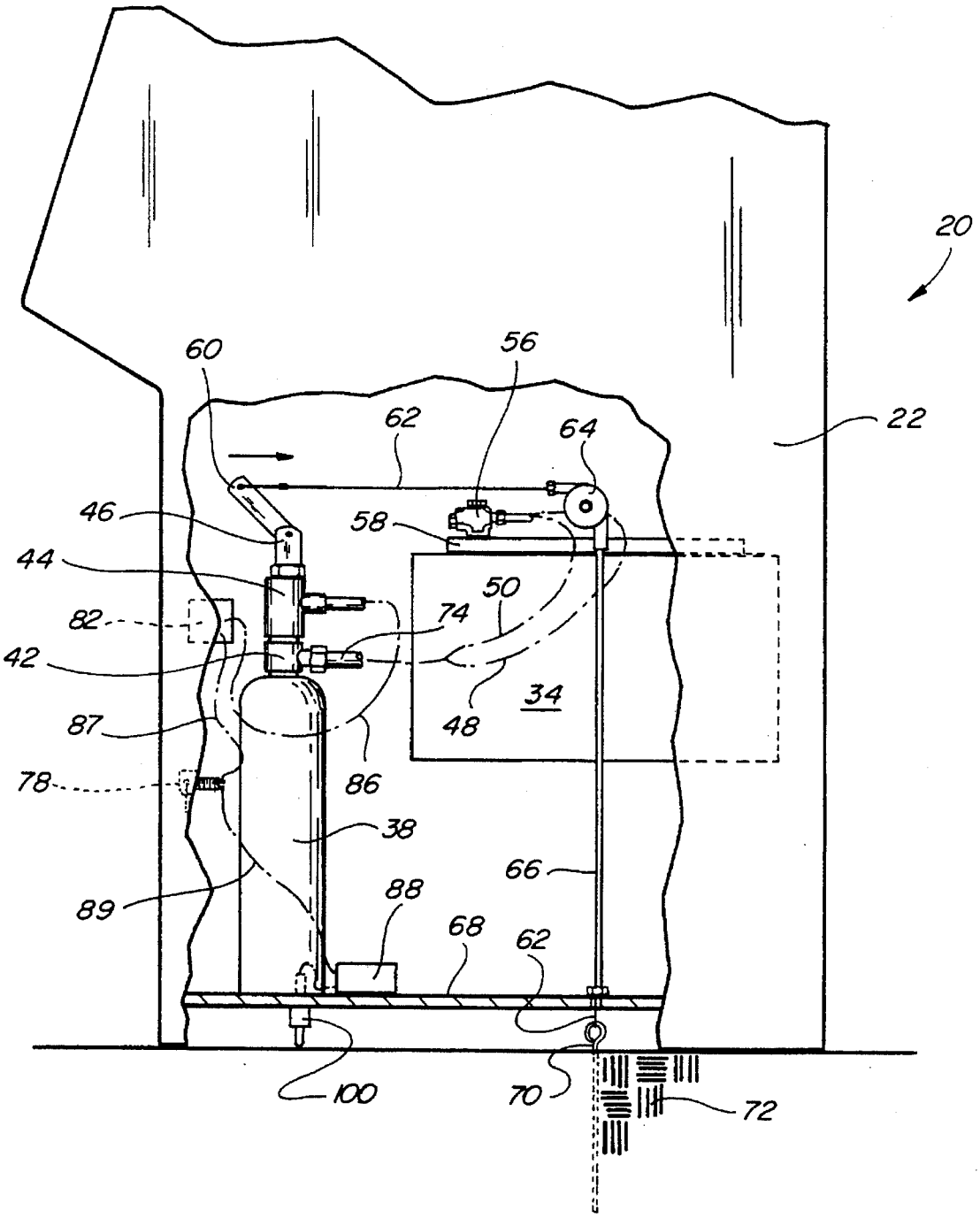
FIG. 3 is a side partial cut-away view of the improved ATM of FIG. 1.
Figure 4:
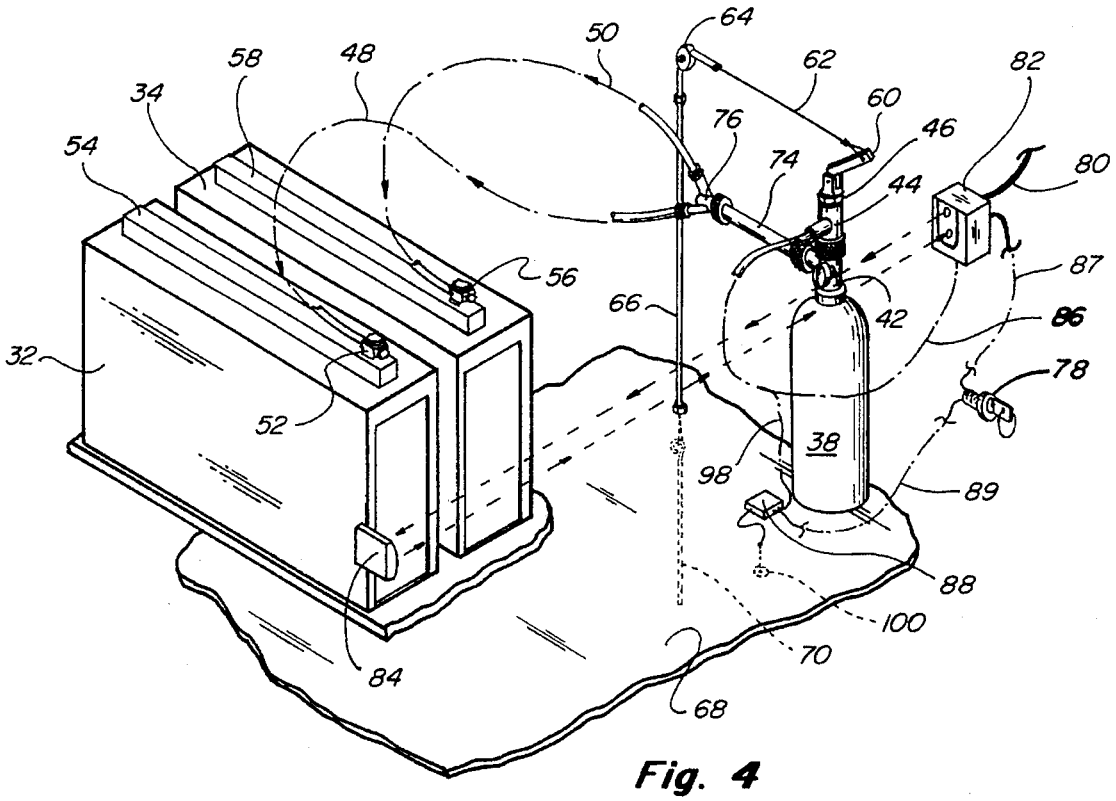
FIG. 4 is a fragmentary view of the inside of the ATM of FIG. 1 showing an embodiment of the present document defacing apparatus.
Figure 6:
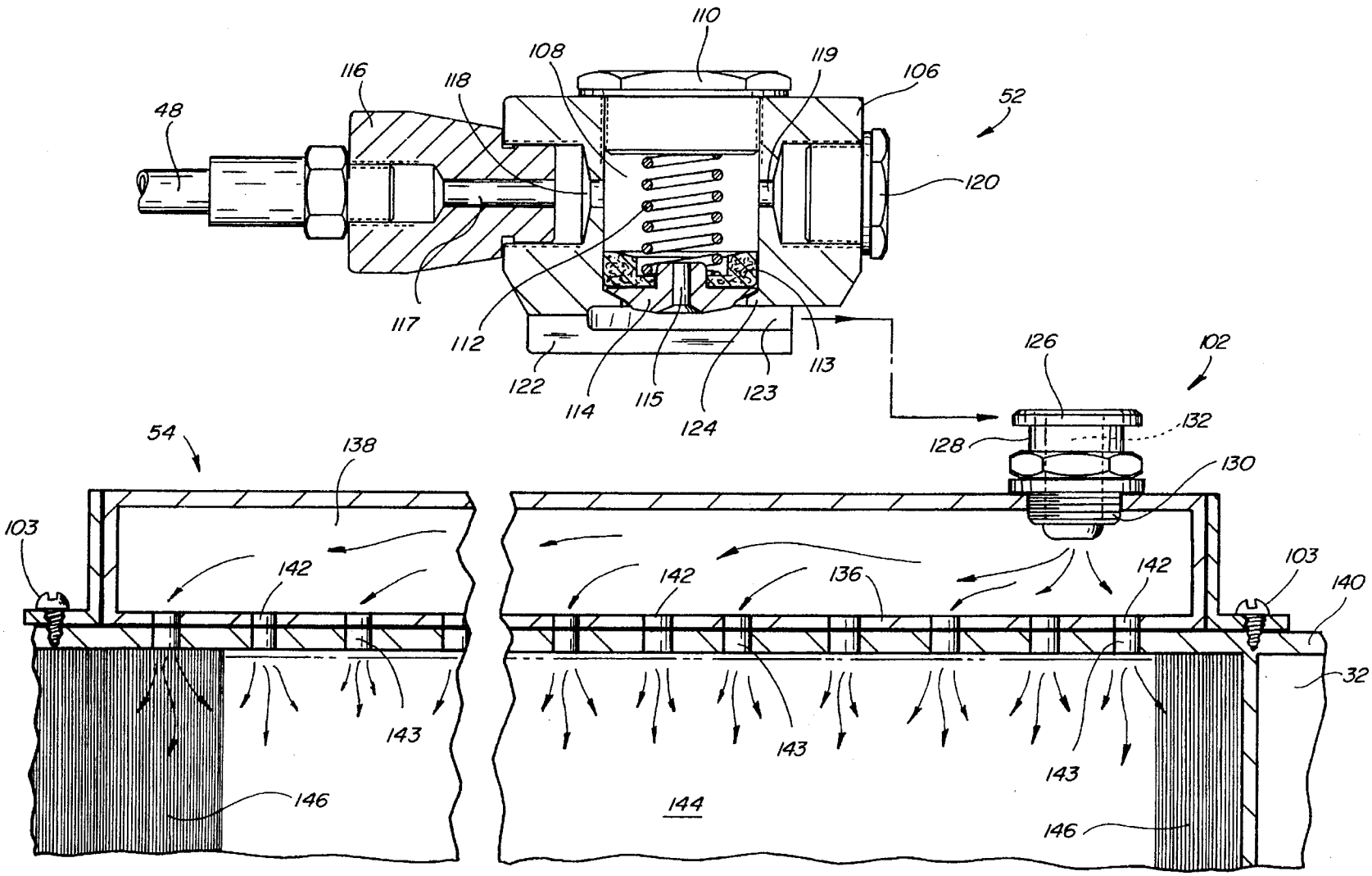
FIG. 6 is an enlarged fragmentary sectional view of the manifold as attached to an ATM money cassette and the buttonhead coupling connection thereto.

Referring now to FIG. 3 lever actuator 46 includes a pivoting lever or arm 60 which is attached to a cable 62. Cable 62 extends through an elbow joint 64 having an internal pulley which is affixed onto a tube or pipe 66 which is secured to ATM housing floor 68. Cable 62 thus runs through elbow 64 and pipe 66 and extends through housing floor 68 such that it is attached to a swivel bolt 70 which is fixedly attached to the ground or earth 72. As described hereinabove, pressure valve 42 is opened in order to release the contents (ink or dye) of tank 38 via a pin type valve of the same type as are used to fill and relieve pressure in pneumatic tires. Actuator 46 includes an internal pin which longitudinally moves within actuator 44 and when moved in a downward position by lever 60 causes valve 42 to relieve the pressure as hereinabove described to allow the ink within tank 38 to be released therefrom and into hoses 48 and 50. Lever 60 is caused to pivot on actuator 46 in order to release valve 42 upon an attempt to remove ATM 20 from its location. As can be appreciated in FIG. 3, as housing 22 is moved from its location, cable 62 being secured to ground 72, will pull pivot lever 60 in the direction of the arrow adjacent lever 60 to cause opening of valve 42 and the release of the contents of tank 38 in the money cassettes. Thus, the indelible ink contained under pressure within tank 38 is released into hoses 48 and 50 and into the cassettes 32, 34 when someone attempts to dislodge or remove ATM 20 from its location. As will be described in detail hereinbelow, the pressurized ink from tank 38 thus enters cassettes 32, 34 to stain the bank notes and/or documents contained within the cassettes. It should be noted that tank 38 is positioned near the front (screen side) of the ATM, while buttonhead couplers 56 releasably connects hose 50 to manifold 58. The buttonhead couplers 52 and 56 are identical in construction to each other. A section view of the buttonhead coupler 52 is shown later in FIG. 6. Those skilled in the art will recognize that the hose 48 can be connected to either side of the buttonhead coupler 52, upon removal of plug 120 and reversal of the coupling 116. In FIG. 6 the horseshoe shaped recess 123 opens opposite to the hose 48 as attached to the buttonhead coupler 52. In FIGS. 3 and 4 it is preferred to reverse the hose 48 so it is on the same side of the coupler 52 as the opening to the recess 123. In this fashion, an operator can tug on the hose 48 to ensure a firm connection between the coupler 52 and the buttonhead 102.

Referring now to FIG. 4, the overall system is shown in greater detail and the electrical actuation of valve 42 to release the pressurized ink from tank 38 will be described. It should be here appreciated that tank 38 is connected to hoses 48 and 50 via a discharge fitting 74 via a one-to-two line coupler 76, however, only one money cassette or a plurality of money cassettes may be attached to tank 38 as long as tank 38 has adequate pressure to supply and adequately soak the bank notes contained in each cassette which is provided by the present invention. Furthermore, in FIG. 4, tank 38 is positioned near the rear of ATM, with buttonhead couplers 52, 56 likewise positioned near the rear. Thus, it is apparent that tank 38 may be positioned anywhere within the ATM and in any orientation. Also, button couplers 52, 56 may be positioned anywhere along the respective manifold. Solenoid actuator 44 like actuator 46 includes a longitudinally extending piston which acts upon valve 42 to relieve the pressure and thus the contents of tank 38 upon downward movement of the actuating rod (not shown). Thus, when an electrical signal is supplied to solenoid actuator 44 valve 42 is actuated and the contents are then released from tank 38 into lines 48 and 50 through manifolds 54 and 58 into respective cassettes 32 and 34.

This electrical signal may be supplied to solenoid actuator 44 in a variety of ways. Such electrical means for releasing the contents of tank 38 may be used either alone or all together and in conjunction with the manual actuation via actuator 46, lever 60, and cable 62. The solenoid actuator 44 utilized in the present embodiment is actuated by a 12 volt 0.57 amp signal applied thereto. Thus, power of this type needs to be available. For this, each electrical component is attached to a power source (not shown) through power source line 80. Such power source may come from a step-down transformer tied into the electricity supplying the ATM with a battery backup should power be interrupted. Furthermore, the power may be supplied by a battery alone. It should be noted that a key switch 78 is utilized to turn off the electrical activation systems for changing the cassettes and/or doing repairs to the ATM.

One such electrical system consists of an infrared or other similar transmitter 82 and reflector 84 which projects an invisible infrared beam to reflector 84 which bounces back to infrared transmitter 82. As an example, transmitter 82 may be a Safe House Infrared Photorelay Sensor as sold by the Tandy Corporation. Should the beam be interrupted by removal of a money cassette, unit 82 sends a signal via line 86 to actuate solenoid actuator 44 to thereby release the ink under pressure within tank 38 to mark the bills contained within the cassettes. Unit 82 is connected to key switch 78 via line 87.

Figure 7:
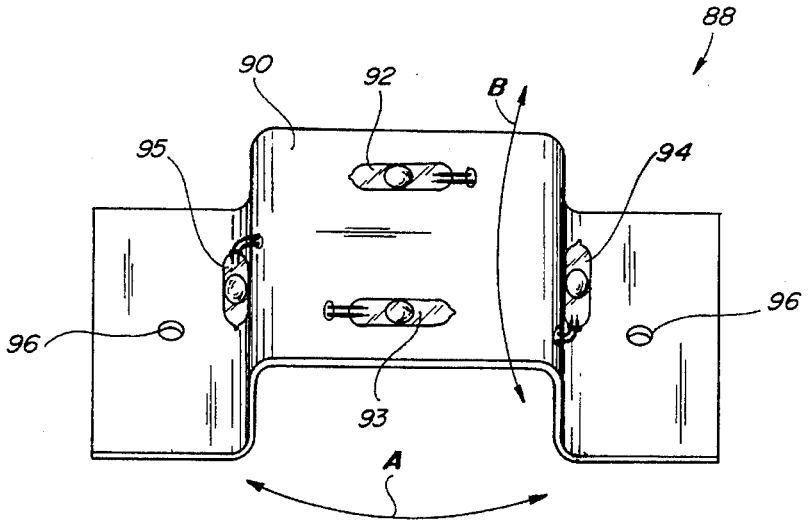
FIG. 7 is an elevational view of a mercury switch array according to the present invention.

Another electrical actuation system is a mercury switch array or system 88 which is attached to ATM housing floor 68. Mercury switch array 88 is connected to the power source via lead 89 with key switch 78 interposed therebetween for deactivation of mercury switch array 88 during cassette change. Additionally referring to FIG. 7 there is shown an embodiment mercury switch array 88. Essentially, mercury switch array 88 includes a shaped metal plate 90 on which are disposed four mercury switches 92, 93, 94, and 95. Mercury switches 92–95 are oriented such that all four directions of movement away from a horizontal plane will activate one of the switches. Switches 92 and 93 are oppositely oriented such that movement in either direction away from the horizontal as indicated by arrow A causes contact to be made and a signal sent to solenoid actuator 44 via lead 98 in order to open valve 42 and release the dye under pressure within tank 38. Mercury switches 94 and 95 are oriented such that movement in a direction off the horizontal as indicated by arrow B will cause one of the switch contacts to be closed and send a signal via line 98 to solenoid actuator 44 to open valve 42 to thus relieve the contents of tank 38.

Another electrical component is a contact switch 100 which, when floor 68 is raised from the ground, will complete the circuit to send a signal via line 98 to solenoid actuator 44 to open valve 42 thereby releasing the contents of tank 38 into hoses 48 and 50.

Figure 15:
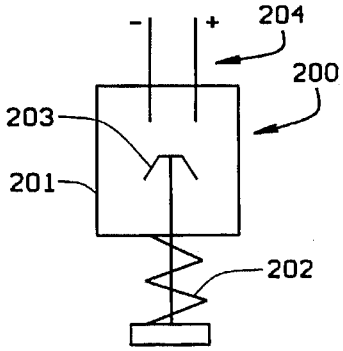
FIG. 15 is a schematic of a contact switch signal generating device.

An embodiment of a contact switch is shown in FIG. 15. A contact switch 200 consisting of a housing 201 includes a spring loaded plunger 202. The spring loaded plunger includes a contact head 203 that makes the electrical connection between connectors 204.

Figure 13:
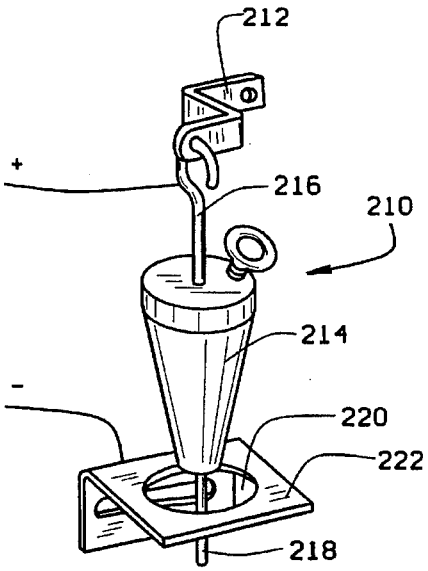
FIG. 13 is an enlarged elevation view of a pendulum tilt signal generating device.

A further component may be utilized to generate the actuating signal, such as a pendulum tilt mechanism 210 is shown in FIG. 13. Such pendulum tilt mechanisms have been used in such items as pinball machines as a tilt sensing mechanism. The pendulum tilt mechanism 210 includes a hanger bracket 212 that supports a metal plumb bob 214 via a hook 216. The plumb bob includes a shaft 218 extending from its lower end. The shaft 218 extends through a hole 220 formed in a lower contact bracket 222. The hook 216 is coupled to one polarity of the power source, while the contact bracket is coupled to the other polarity of the power source. When the ATM is tilted, the shaft 218 will contact an edge of circle 220 of the contact bracket 222 to complete the electrical circuit and provide the necessary signal.

Figure 14:
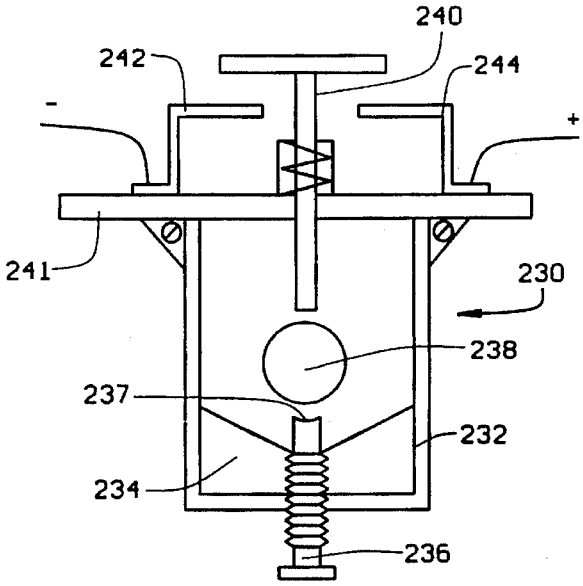
FIG. 14 is an enlarged cutaway view of a gravity ball tilt signal generating device.

Additionally, a gravity ball tilt mechanism 230, as shown in FIG. 14, may be utilized to produce the actuation signal for the actuator. Such a gravity ball tilt mechanism is disclosed in U.S. Pat. No. 4,799,505, which is incorporated herein by reference. However, a short description of the main components and method of operation are as follows. The gravity ball tilt mechanism 230 includes a housing 232 that has a concave bottom portion 234. Threadedly received in the center of the concave bottom 234 is a threaded screw 236. The threaded screw 236 includes a concave upper end designed to hold a steel ball 238. A spring loaded T-contact 240 is naturally biased downwardly. The steel ball is placed in the concave portion 237 while the T-contact 240 is held in the open position. Once the ball 238 is in place, the T-bar 240 is lowered thereon. At this point, the T-bar does not make contact between lead brackets 242 and 244. Once the gravity ball tilt mechanism 230 is tilted enough, gravity will pull the steel ball away from the concave portion 237, whereupon the T-contact 240 will be biased downwardly to make contact between the contacts 242 and 244 thereby providing the actuating signal.

Thus, the present invention contemplates the use of mechanical/manual actuation and/or electrical actuation. The electrical actuation system is deactivated via key switch 78 in order for authorized personnel to exchange the money cassettes when necessary.

Figure 8:
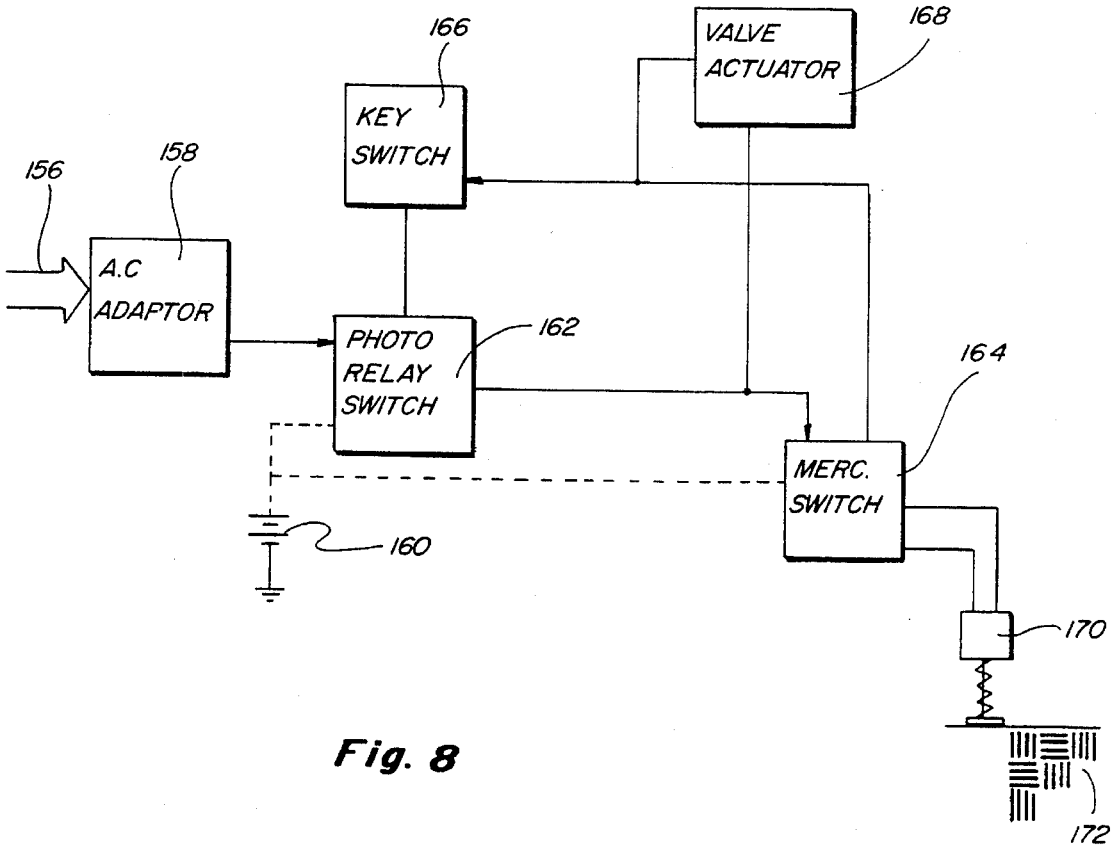
FIG. 8 is a schematic of one embodiment of a mechanical and electrical actuating system for the present invention.

The connection of one embodiment of the electrical actuation system is shown in block diagram in FIG. 8. Essentially, the main power source 156 is connected to an AC adaptor or transformer 158 in order to step down the voltage and amperage to the required values. AC adaptor 158 thus supplies power to photo relay switch 162, mercury switch 164, and pressure switch 170. A battery back-up 160 may also be provided should power be interrupted. A key switch 166 is interposed between photo relay switch 162 and mercury switch 164/contact switch 170 so that the cassettes may be exchanged without triggering the system. Valve actuator 168 is operatively connected to key switch 166, photo relay switch 162, mercury switch 164, and pressure switch 170 such that actuation of any of these switches sends a signal to valve actuator 168 to cause the indelible ink under pressure within tank 38 to be dispensed into cassette 32 to blur documents 146 within chamber 144.

Figure 10:
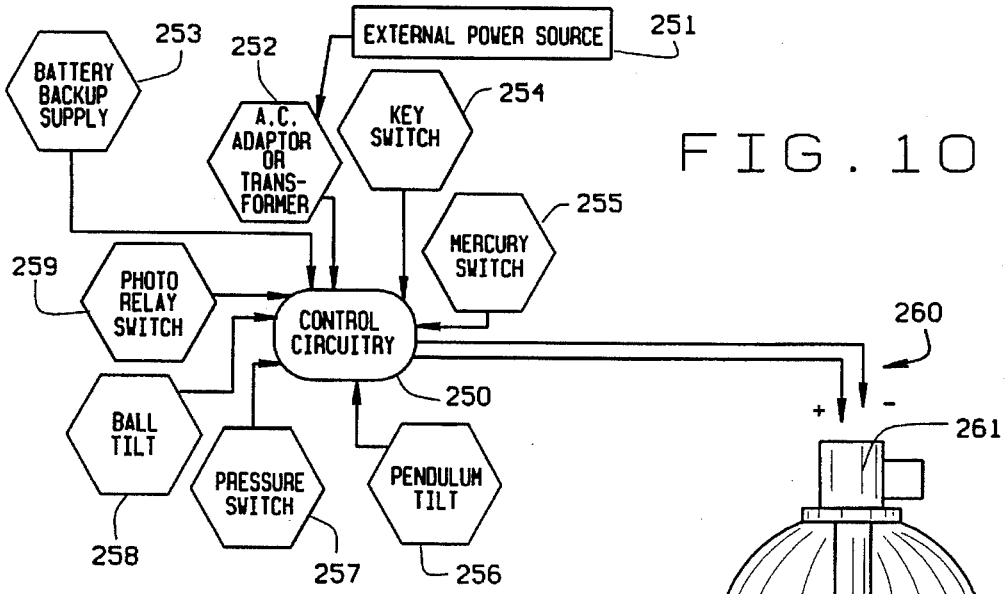
FIG. 10 is a schematic of a further embodiment of the actuating and releasing system.

In a further embodiment in which actuation is initiated by an electrical signal and an electrical signal is caused to initiate the release of pressurized fluid from the tank, which is described hereinbelow, reference is made to FIG. 10 showing an alternative schematic embodiment. Rather than providing mechanical actuation or a mechanical/electrical actuation, it may be preferable to utilize an all electrical actuation system. Logic circuitry 250 consisting of well known components provides the linking of the various components and the generation of an output signal. An external power source 251, usually an A.C. source, may be converted through an A.C. adapter or transformer 252 to provide power to the control circuitry 250. Coupled to the control circuitry 250 is a battery backup supply 253 in case of power failure. A capacitor or other components may be needed within the control circuitry 250 when the control circuitry 250 is utilizing the battery backup. Such circuitry is well known in the art for initiators. Additionally, key switch 254 may be utilized to turn the system on and off for loading and unloading of the money cassette. Also coupled to the control circuitry 250 are signal generating devices mercury switch 255, pendulum tilt mechanism 256, pressure switch mechanism 257, ball tilt mechanism 258, and photo relay switch 259. Also coupled to the control circuitry are electrical leads 260 which are coupled to the electrical initiating device 261 disposed on top of pressurized tank 262. Such an electrical initiating device to release the pressurized liquid will be described hereinbelow, with reference to FIGS. 11 and 12.

Figure 5:
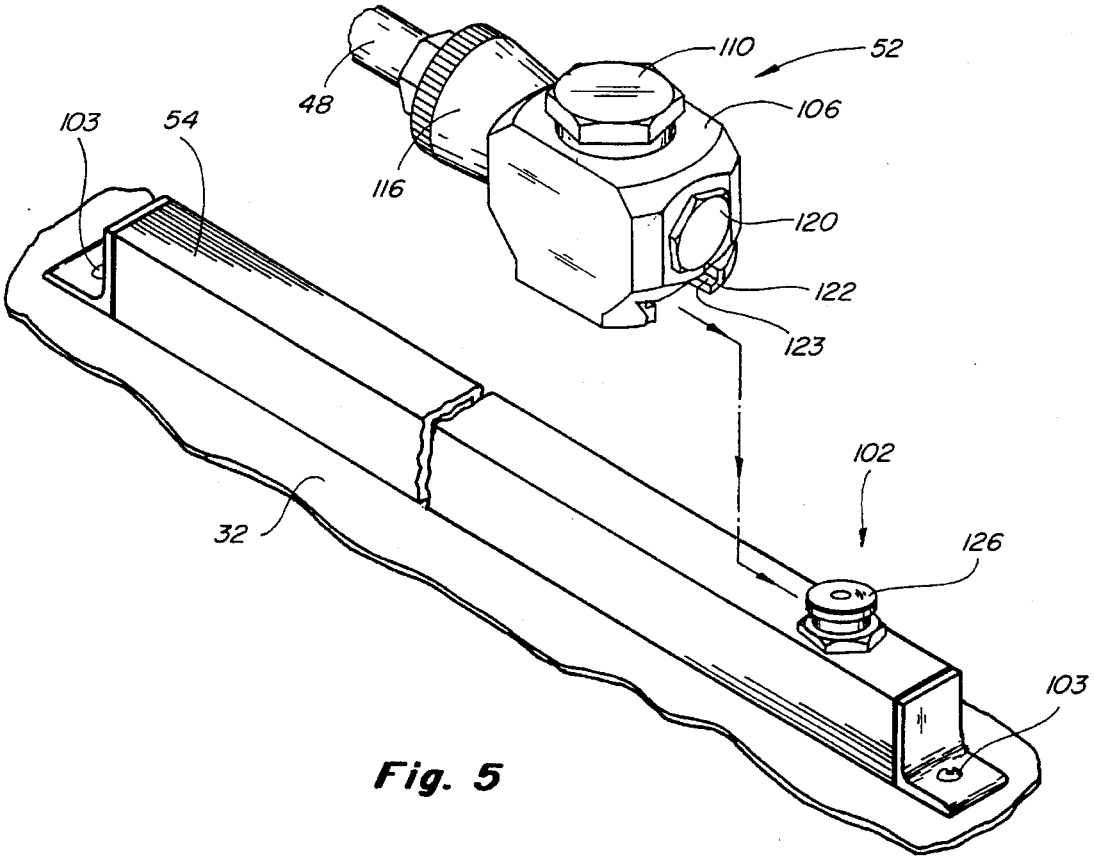
FIG. 5 is an enlarged fragmentary view of the manifold and buttonhead coupling connection.

Referring now to FIG. 5, there is shown the manner of connection of hose 48 to manifold 54. It should be appreciated that FIG. 5 shows the connection of hose 48 to manifold 54 such that the contents of tank 38 may be in fluid communication with manifold 54 upon opening of valve 44 which is the same manner as the connection to the other cassettes. Hose 48 terminates with a standard button coupling 52 which slidably attaches to a standard buttonhead 102. Buttonhead 102 is threadedly received in manifold 54, while manifold 54 is secured via bolts 103 and/or a sealant, such as, for example, glue to cassette 32. It should here be appreciated that although manifold 54 is shown attached to the top of cassette 32 as a separate member, such manifold may be disposed inside cassette 32 or alternatively be formed as a part of the top wall of cassette 32. In this embodiment hose 48 is flexible and thus when cassette 32 is installed in tracks 33, coupling 52 must be manually slid onto buttonhead 102.

Referring now to FIG. 6 there is shown the hose connection manifold and cassette in a sectional showing the manner of connection of hose 48 with cassette 32 and the flow of dye through manifold 54 and into cassette 32. As previously stated, hose 48 terminates with a standard button coupling 52. Button coupling 52 comprises a housing 106 which defines an internal cavity 108. Cavity 108 extends from the upper surface of housing 106 and is plugged by a threaded cap 110. Hose 48 is coupled to coupling 116 having a bore 117 to allow fluid communication between hose 48 and chamber 108 of button coupling 52 via tapered bore 118. Coupling 116 is threadedly received in bore 118, thus fluid in hose 48 will enter button coupling 52 via bores 117 and 118. Housing 106 of button coupling 52 further includes a tapered bore 119 diametrically opposed to bore 118 which is sealed by a threaded nut or cap 120. Bore 119 may be used to connect another fluid source or to allow limited by-pass thereof. Disposed within chamber 108 is a spring 112 which, along with cap 110 biases a disk 114 in the downward direction. Tapered disk 114 is restrained from exiting chamber 108 by annular taper 124, which restricts disk 114 from downward movement but allows upward movement upon engagement with buttonhead 102 as described hereinbelow. Disposed around spring 112 is a washer 113 adjacent disk 114 for guiding spring 112. It should be appreciated that cap 110, when in the position shown in FIG. 6, compresses spring 112 so as to bias disk 114 in the downward position. Disk 114 includes a bore 115 which provides communication between chamber 108 and the outside of housing 106. In order to attach button coupling 52 to buttonhead 102, housing 106 includes a horseshoe shaped ledge 122 which defines a horseshoe shaped recess 123. Ledge 122 and recess 123 cooperatively act to retain annular portion 126 of buttonhead 102 by surrounding the same such that cylindrical portion 128 of buttonhead 102 is engaged with ledge 122. Thus, as button coupling 52 is slid onto buttonhead 102 in the direction as indicated by the arrow, disk 114 is upwardly biased such that a snap-like fit completes the coupling. Buttonhead 102 includes threads 130 and is threadedly received in upper wall 134 of manifold 54. An internal bore 132 of buttonhead 102 provides communication between button coupling 52 and interior chamber 138 defined within manifold 54. Lower wall 136 of manifold 54 includes a plurality of bores 142 extending therethrough and aligned with like bores 143 in top wall 140 of cassette 32. Thus, bores 142 and 143 cooperatively act to permit communication between chamber 138 of manifold 54 and chamber 144 of cassette 32. Disposed within chamber 144 are bank notes or documents 146 which will be blurred by the indelible ink upon actuation of the present system.

FIG. 6 thus shows the flow pattern of indelible ink which is under pressure and as it enters buttonhead 102 is caused to enter chamber 138 of manifold 54 to be released via bores 142 and 143 onto bank note 146 within chamber 144 of cassette 32.

Figure 9:
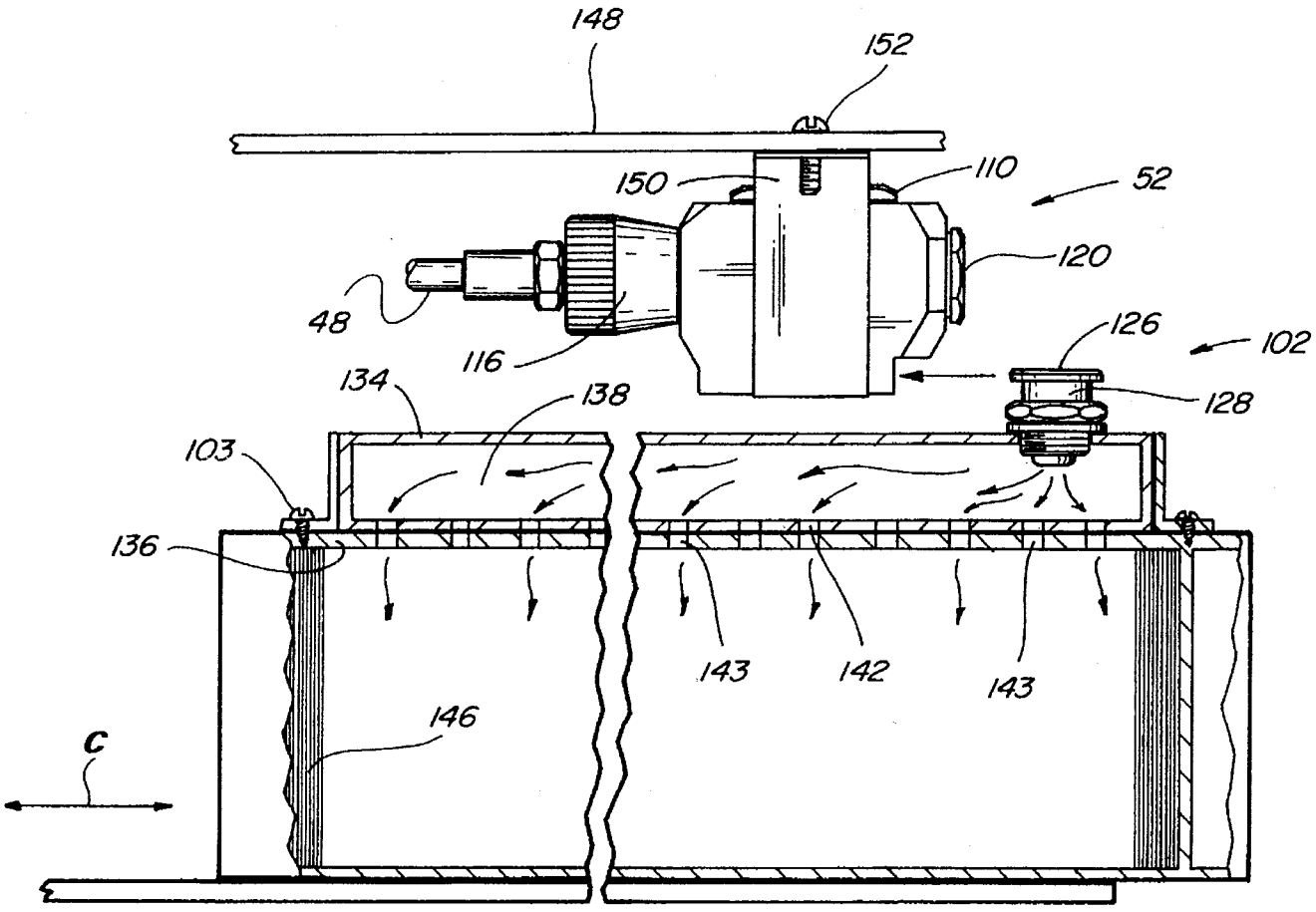
FIG. 9 is an enlarged fragmentary sectional view of the manifold as attached to an ATM money cassette having an alternative embodiment of the hose connection.

Referring now to FIG. 9 an alternative embodiment regarding hose 48 and the connection of hose 48 to buttonhead 102 is disclosed. As mentioned hereinabove, in the embodiment shown in FIG. 6, hose 48 is flexible and thus when cassettes are changed, button coupling 52 must be manually removed from buttonhead 102 and thus subsequently manually replaced thereon. However, since the money cassettes are placed within the ATM with such close tolerances such that a vacuum can pull the money contained therein for dispensing to the user, such would lend itself to fixing button coupler 52 such that the process of removing the cartridge as indicated by arrow C in a horizontal direction and the replacement of a new cartridge in a horizontal direction as represented by arrow C automatically couples buttonhead 102 with button coupling 52. In this manner, button coupling 52 is mounted in a bracket 150, while bracket 150 is fixedly mounted to a shelf 148 via rivet or bolt 152 within the ATM. Thus, in this embodiment there is no manual connection and the simple process of loading and unloading the cassette uncouples and couples the present system. Furthermore, since pressurized ink is forced into the cassette container to blur the documents, the uncoupling and coupling of the present system is not hazardous or dangerous since there are no "live" charges or wires. For the embodiment shown in FIG. 9, hose 48 is a ⅝ inch I.D. hose coupled to a ½ inch hose shank 116 welded to buttonhead 120. Buttonhead 120 is modified at its inlet to accommodate the ½ inch hose shank. Inventor recommends that 12 or more bores 142 be formed in manifold 54 to align with a corresponding number of bores 143 in the top wall 140 of cassette 32. However, depending on pressure hose sizes and other factors, the number of bores may be increased or decreased.

Figure 16:
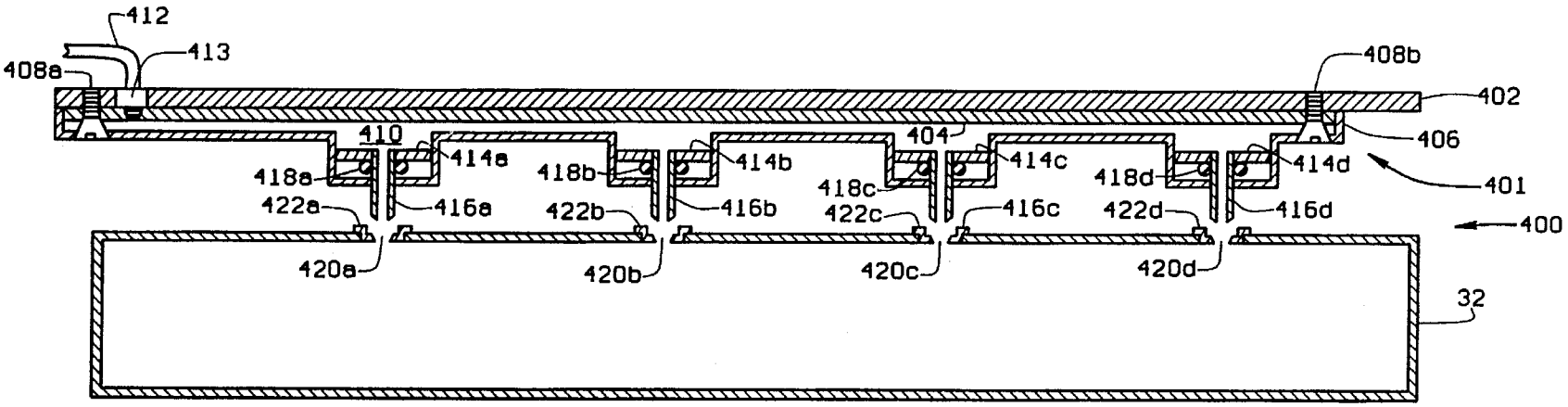
FIG. 16 is an enlarged sectional view of the distribution manifold and money cassette according to another embodiment of the present invention.

Referring now to FIG. 16 an alternative embodiment of an ink delivery or distribution system 400 is shown generally.

The distribution system 400 is composed of a distribution manifold 401 constructed from a manifold support plate 402, an interior manifold structure 404, and an exterior manifold structure 406. Two screws 408*a* and 408*b* are used to hold the manifold structures 404 and 406 to the support plate 402. An ink discharge line 412 enters the manifold 401 through a bore 413. When activated, ink under pressure in the ink tank flows through the discharge line 412 into the manifold chamber 410. The ink flow applies pressure to piston-type ink guides 414*a*–414*d*, thus forcing the attached nozzles 416*a*–416*d* to extend outwardly. Bores 420*a*–420*d* are drilled in the money/document cassette 32. Optionally, bushings 422*a*–422*d* are inserted into bores 420*a*–420*d* to provide better fluid communication between nozzles 416*a*–416*d* and the chamber 144 of cassette 32, thus reducing ink loss. Optionally, o-rings 418*a*–418*d* are placed around nozzles 416*a*–416*d* near ink guides 414*a*–414*d* to prevent the ink from seeping out of the distribution manifold except through nozzles 416*a*–416*d*. It is important to note that the manifold does not need to have exactly four nozzles. Any number of nozzles may work, except that the more nozzles distributed over the length of the manifold, the better the coverage of the bills by the ink.

Figure 17:
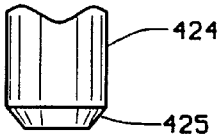
FIG. 17 is an enlarged elevation of the nozzle tip from the distribution manifold of FIG. 16.
Figure 18:
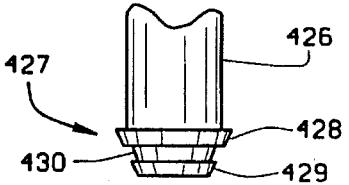
FIG. 18 is an enlarged elevation of an another embodiment of the nozzle tip from the distribution manifold of FIG. 16.

The discharge end 424 of nozzle 416 is shown in FIG. 17. The tip of the discharge end 424 culminates with a beveled surface 425 to provide better fluid communication either directly into bores 420 of FIG. 16 or if used, bushings 422 of FIG. 16. An alternative embodiment of the discharge end 426 is shown in FIG. 18. Here the beveled surface 427 includes an upper enlarged diameter, annular rim 428 and a lower enlarged diameter, annular rim 429. The rims 428 and 429 define an annular o-ring groove or channel 430 in which may be disposed an o-ring (not shown).

Figure 19:
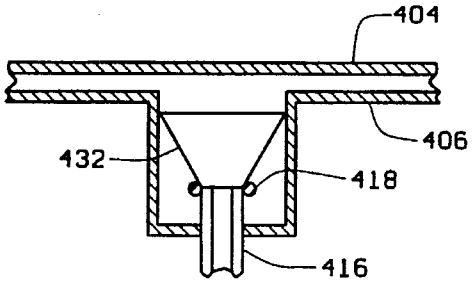
FIG. 19 is an enlarged sectional view of a funnel type ink guide that may be used in the distribution manifold of FIG. 16.

FIG. 19 shows a funnel-type ink guide 432 used as an alternative to the flat head piston-type ink guide 414 of FIG. 16. As shown, the optional o-ring 418 may also be used with the funnel-type ink guide 432.

Figure 20:
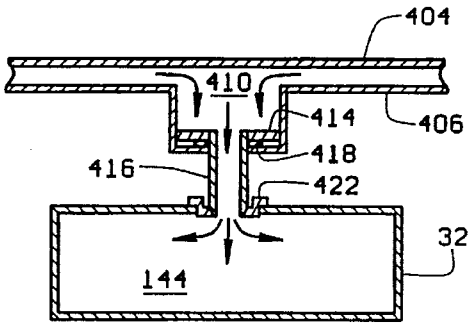
FIG. 20 is an enlarged sectional view of a portion of the distribution manifold showing a nozzle in an extended state and in contact and fluid communication with its corresponding hole in a banknote cassette.

FIG. 20 shows the piston-type ink guide 414 and the attached nozzle 416 in an extended state as would happen upon the discharge of the ink. The end of the nozzle 416 is contacting the bushing 422, thereby placing the manifold chamber 410 in fluid communication with the chamber 144 of the money/document cassette 32. This embodiment is a more cost effective delivery system, because the money cassettes 32 and 34 do not need to be significantly altered. Bores 420 must be drilled in the cassettes 32 and 34 and optionally bushings 422 inserted therein. This allows the system to be used in conjunction with many types of cassettes of varying sizes and specifications. It should also be noted that the bores 420 need not be drilled in the top surface of cassette 32. Rather the side, or even the bottom surfaces of the cassette 32 should also be able to accommodate the bores 420. The distribution manifold would be mounted or placed accordingly, relative to the location of the bores in the cassette.

Figure 11:
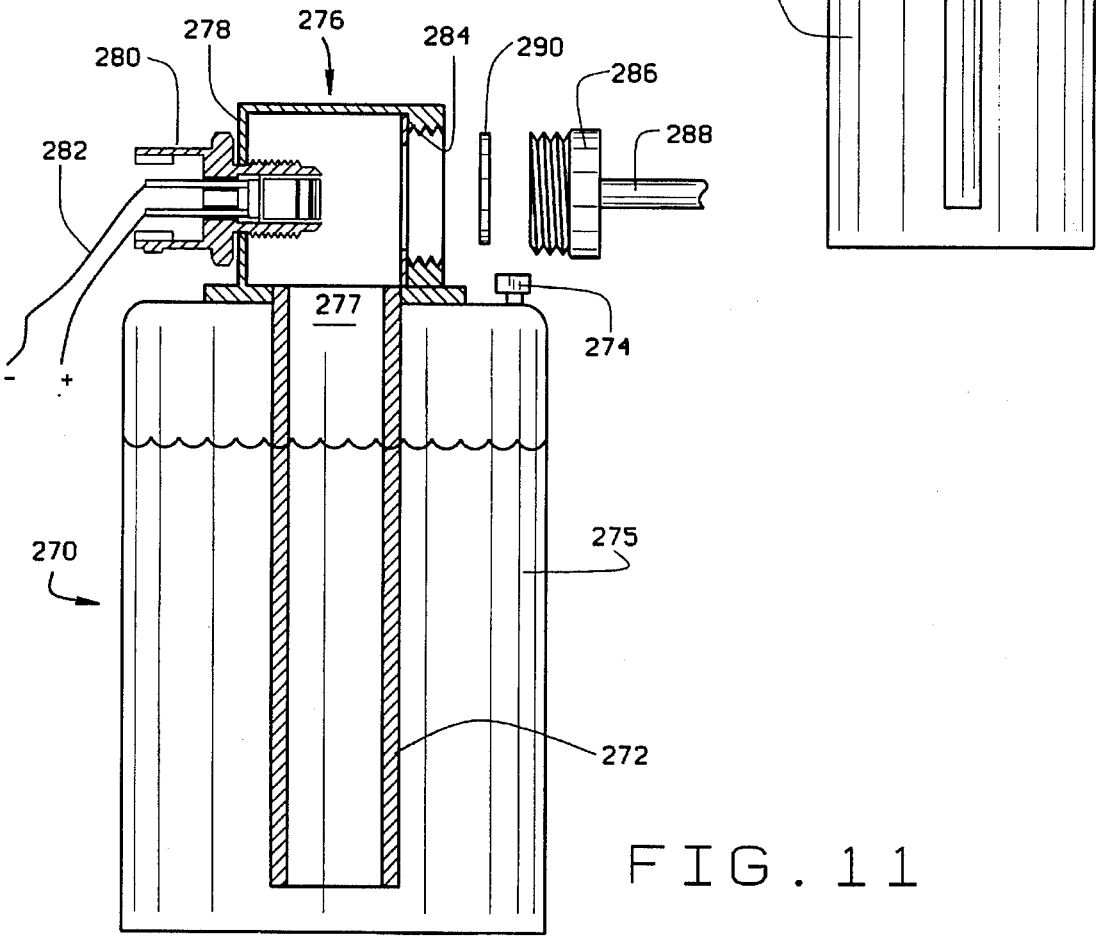
FIG. 11 is an enlarged cutaway side view of the pressurized tank with an initiator and rupture disc according to another embodiment of the present invention.

An alternative embodiment of the ink releasing means is depicted in FIG. 11. Preferably, this embodiment is utilized in conjunction with the type of circuitry and signal generating means disclosed in FIG. 10 and described hereinabove. This system includes a pressurized tank of any suitable type made to hold its contents at various pressures as, for example, in the range of 300–1000 psi. Here, tank 270 is an 18 lb. tank. The tank includes an inner pick tube with a wall thickness of 4/32 of an inch that includes an air fill valve 274 and which is shown filled with an indelible dye or ink 275. Disposed on the top portion of the tank 270 is a cap or housing 276 constituting a valve for the tank along with the other components associated therewith which fits over an opening 277 of the pick up tube 272. Disposed in a side wall 278 of the cap 276 is a power cartridge initiator 280. The power cartridge initiator 280 is of a conventional type such as that manufactured by Hi-Shear Corporation. Such a power cartridge generates a gas upon electrical ignition through leads 282. This signal is provided through the control circuitry 250 as disclosed in FIG. 10. Also, a bulk head ignitor may be utilized as the pyrotechnic initiator, however, a power cartridge is preferred as the initiator. The cap 276 includes a threaded opening 284 opposite the power cartridge 280. Threadedly disposed in the opening 284 is a connector 286 coupled to the stainless steel conduit 288 for delivery of the ink once it is released into the manifold of the cassette. The coupling 286 includes a seal or rupture disc 290 that is preferably of a non-fragmenting design. Such rupture disc are available from LaMot Corporation of Continental Disc Company of Liberty, Mo. The rupture disc is of sufficient strength to contain the pressurized fluid 275 within the tank 270 while at the same time rupturable without fragmentation once the power cartridge 280 is initiated and the gas expelled therefrom contacts the ruptured disc. Therefore, in this embodiment a change of power cartridge and rupture disc are all that is needed to recharge or reactivate this system.

Figure 21:
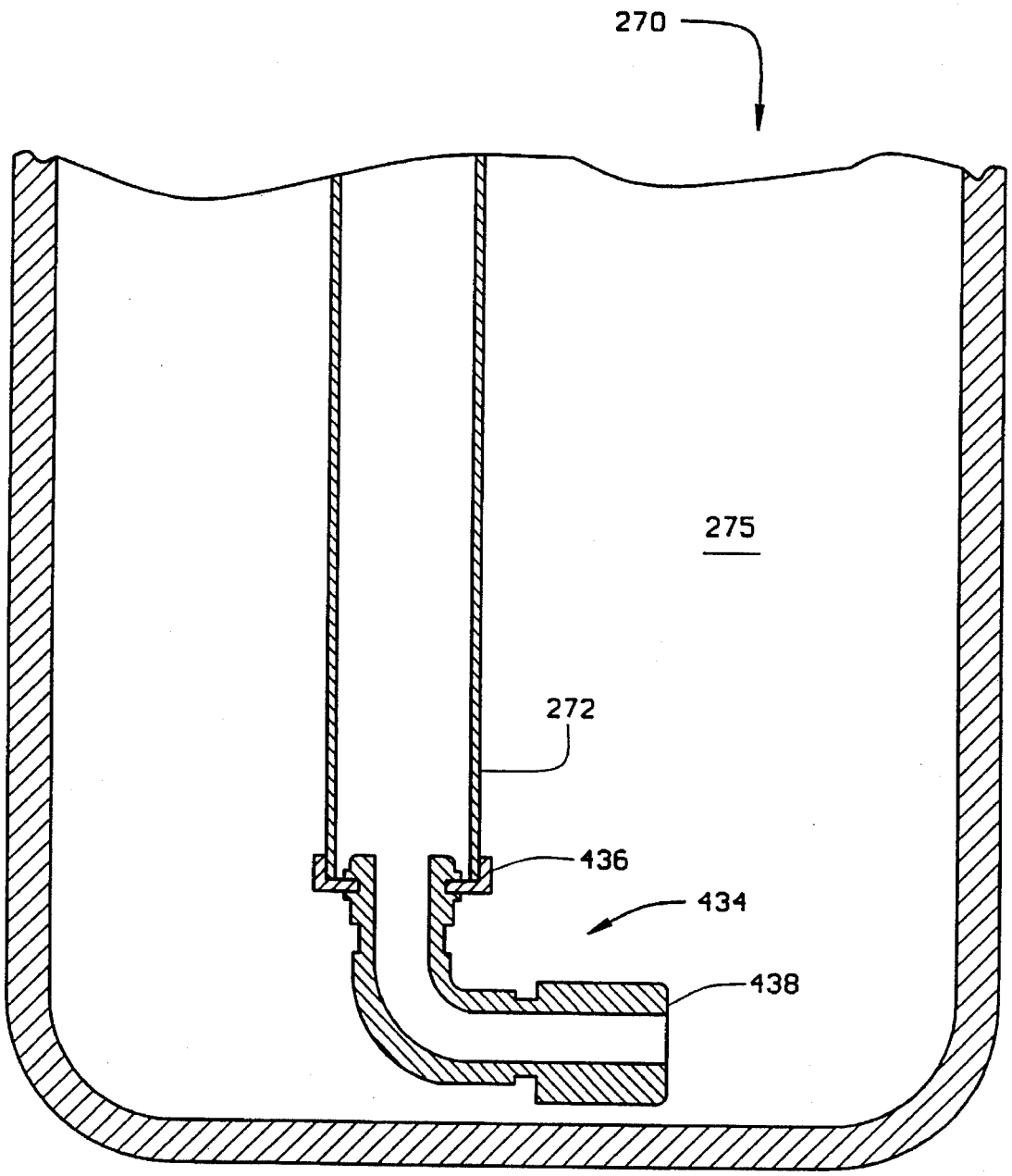
FIG. 21 is an enlarged sectional view of a lower portion of a pressurized ink tank and associated pick up tube fitted with a swiveling elbow-shaped extension.

FIG. 21 shows the pick up tube 272 inside the pressurized tank 270. The pressurized tank is filled with ink 275. The pick up tube is fitted with an optional swiveling extension 434 that rests at the bottom of the tank. The swiveling extension 434 has a flange 436 about a groove in one end of the swiveling extension 434. That flange is permanently coupled to the intake end of the pick up tube 272. After the flange 436 is in place, the swiveling extension 434 is free to rotate about the flange 436. The swiveling extension 434 is primarily elbow-shaped and hollow to extend the effective reach of the pick up tube 272. The walls of the swiveling extension 434 are made much thicker in the proximity of the intake end to form a weight 438. When the ATM, and thus the pressurized tank 270 are tilted, the weight 438 causes the swiveling extension 434 to rotate downward. Therefore, even after gravity pulls the ink 275 out of reach of the pick up tube 272 in a tilted pressurized tank 270, the swiveling extension 434 can reach additional quantities of ink 275. The additional quantities of ink may be necessary to fully stain the currency within the cassettes. It thus delivers more ink to the cassettes.

Figure 12:
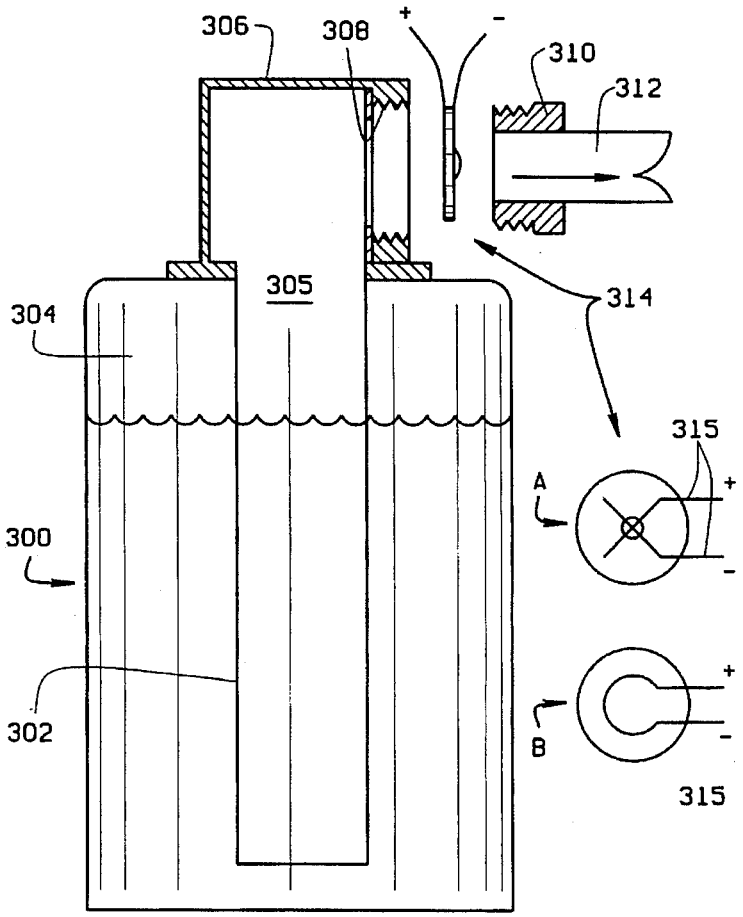
FIG. 12 is an enlarged cutaway side view of the pressurized tank utilizing an explosive rupture disc according to another aspect of the present invention.

Referring to FIG. 12, an alternative embodiment of the all electrical initiation system is provided. A tank 300 of the same characteristics as tank 270 includes a pick up tube 302 and in which is housed a pressurized fluid 304. A housing 306 extends over an opening 305 of the pick up tube 302 and includes a threaded opening 308. A coupling 310 is sized to threadedly be received in opening 308 and is coupled to a stainless steel discharge conduit 312. Disposed in the opening 308 and held in place by the coupling 310 is an electrical explosive initiator disc 314 that includes electrical leads 315 that are coupled to the logic circuitry. The disc or seal 314 may take the form as represented by "A" and "B" in FIG. 12. Essentially, the seal includes a pinpoint explosive shaped charge that ruptures the disc upon the application of a suitable electrical signal.

OPERATION

The overall operation of the present system will now be described. With particular reference to FIG. 4, the system is set as described hereinabove and is ready to deface the bank notes and/or documents contained within cassettes 32 and 34 upon a breach of security, unauthorized entry or the attempted removal of the entire ATM. As previously described, if authorized personnel is to change the cassette, key switch 78 is utilized to deactivate the electronic signal generator such that the old cassettes may be removed and new cassettes put in. In the embodiment shown in FIG. 9, the authorized cassette exchanger merely pulls out the old cassettes and puts in the new cassettes since the coupling of the present system with the cassettes is automatic. However, where the hoses are flexible and are not attached so as to be automatic, each button connector 52 must be manually disengaged from buttonhead 102 or its respective button.

With the electrical system actuated, the present system may be triggered by any number of events, and safeguards may be built in such that either manual actuation or electronic actuation will take place upon a breach of security. Thus, in the scenario where the entire ATM, whether it is a stand-alone or wall unit, is moved from its foundation, cable 62 will move lever 60 so as to open valve 42. The opening of valve 42 thus allows the indelible ink contained under pressure within tank 38 to be expelled via hose 74 and into hoses 48 and 50. From that point, the fluid under pressure flows through the respective button coupling 52, 56 and into the respective button. From there the fluid enters the respective manifold 54, 58 and is forced under pressure through the plurality of bores 142 and 143 to thoroughly soak, blur, and deface documents 146. Concurrent with the manual actuation of valve 42 should the entire unit be removed from its foundation, pressure switch 100 will send an electrical signal to solenoid actuator 44 to actuate valve 42 resulting in the same scenario as described above. Furthermore, mercury switch array 88 will also send an electrical signal upon dislodgement against any horizontal plane to send a signal to solenoid actuator 44 to open valve 42. However, should the thief open the ATM, the breaking of the beam emanating from transmitter 82 will cause a signal to be sent to solenoid actuator 44 to open valve 42 with the result as described hereinabove.

The system of FIGS. 10–15 constituting an alternative embodiment of the present invention will now be described. If authorized personnel is to change the cassette, key switch 254 is utilized to deactivate the electronic circuitry and components such that the old cassettes may be removed and new cassettes put in. The key switch is then used to reactivate the system.

With the electrical system actuated, the present system may be triggered by any one of the signal generating devices, mercury switch 255, pendulum tilt 256, pressure switch 257, ball tilt mechanism 258, or photo relay switch 259. If any one of these signal generating devices provides a signal to the control circuitry 250, the control circuitry 250 generates an appropriate signal through leads 260 to initiate the power cartridge 280 or rupture disc 314.

In the case of the power cartridge 280, the electrical signal produces an explosion that creates a gas to rupture the disc 290. Rupturing of the disc 290 allows the pressurized fluid 275 to escape from tank 270 via pick up tube 272 and outlet 277 to flow through the line 288 and into the manifold and cassette thereby defacing the notes contained therein.

In the case of the explosive electrical disc 314, the disc is automatically ruptured upon the receipt of a signal through its leads 315 which allows the ink 304 contained within cylinder 300 to exit via pick up tube 302 and opening 305 through the discharge hose 312 and into the manifold and cassettes.

When used with the alternative embodiment of the distribution system 400 shown in FIG. 16, the actuation of the ink tank still works the same as described above. Instead of ink discharging into a distribution manifold directly attached to the cassette 32, the distribution manifold is composed of a plate 402 and structures 404 and 406, and placed in proximity, but not contacting the cassette 32. When the ink flows from the discharge line 412 into the manifold chamber 410, pressure is applied to either the piston-type ink guide 414 or the funnel-type ink guide 432 (FIG. 19), forcing the ink guide and the attached nozzle 416 to extend. After extension, the nozzle 416 should be in contact with the cassette 32 at a pre-drilled bore 420 in said cassette. This places the manifold chamber 410, and therefore the ink tank 38, in fluid communication with the chamber 144 of cassette 32.

EXAMPLE

As an example of the above present invention, the inventor has utilized an Ansul® 5 lb. halon tank, as described hereinabove, filled with ¾ gallons of rubbing alcohol and a temporary printing press type ink such as an ink pad ink that is water soluble and/or alcohol soluble and pressurized at a working pressure of 400 psi. A single ⅝ inch steel-lined I.D. hose was connected via appropriate fittings to the outlet of tank 38 and to a ½ inch hose shank (male) welded to the button coupling. The button coupling inlet was enlarged to ½ Inch to accommodate the hose shank, while the button coupling outlet was enlarged to ¼ Inch. The spring and ball were both removed. The manifold was a ¾ inch square tube having six ⅛ inch bores therethrough corresponding to ⅛ inch bores in the cassette. Other parties and members were as stated hereinabove. In the test, sufficient pressure at 400 psi was produced with the stated hose and hole dimensions such that the present invention operated as described hereinabove. It should be understood, however, that a general range of 300 to 800 psi's can be used and with particular cassettes, different size tubing, and hole structures the present invention may modify accordingly.

As an example of the tank depicted in FIGS. 11 and 12, the ink should be a non-alcohol or flammable base in view of the type of initiators or liquid releasing devices utilized. The tank is generally a 300–1000 psi tank coupled to a stainless steel ⅜ inch conduit via a suitable connector 286. The non-fragmenting rupture disc 290 is easily replaceable as well as the threaded power cartridge 280.

While the foregoing is directed to the preferred embodiment of the present invention, other and further embodiments of the invention may be devised without departing from the basic scope thereof, and the scope thereof is determined by the claims which follow.

It should be appreciated that there are various configurations and methods of supplying the ink to the money cassettes. Such alternate forms may include the use of a turbine and impeller, an electric motor and impeller, an electric motor and piston positive displacement pump, an electric motor with a centrifugal impeller pump, or an electric motor with an eccentric rotary vane pump. Further, it is contemplated that the cartridge containing the ink may be actuated by an explosive charge and piston configuration, or a chemical reaction expansion created by heating, for example.

What is claimed is:

1. An ATM security system comprising:

an ATM housing;

an ATM device disposed within said housing;

a banknote cassette removably disposed within said housing and in communication with said ATM device;

a plurality of holes disposed in and through a surface of said banknote cassette;

a pressurized tank within said housing, said tank including a cap disposed over an outlet opening in said tank;

an indelible liquid ink stored within said pressurized tank;

a manifold positioned adjacent to said holes and in communication with said ink within said pressurized tank via a conduit extending through said cap;

a plurality of extendable ink guides disposed in said manifold, each said ink guide corresponding to one of said holes, said ink guides extendable in reaction to pressure from said ink upon the release thereof, said ink guides contacting said holes upon extension, thereby providing a distribution path for said ink into said banknote cassette in order for said ink to deface the banknotes contained in said banknote cassette upon release of said ink from said tank;

an electrical signal generating device coupled to said housing;

a pyrotechnic initiator coupled to said cap opposite said conduit;

a rupture disc disposed upstream of said conduit; and an electrical control circuit coupled to said electrical signal generating device, to a source of electrical power, and to said pyrotechnic initiator wherein a signal generated by said electrical signal generating device upon a breach of security of said housing or ATM device is detected by said electrical control circuit and sent to said pyrotechnic initiator that initiates to rupture said rupture disc thereby opening said conduit allowing said pressurized ink to flow from said tank into said cassette.

2. The ATM security system of claim 1 further comprising:

a pickup tube disposed within said pressurized tank and coupled to said outlet opening, said pickup tube extending downward almost to the bottom of said pressurized tank; and a hollow elbow bending approximately 90 degrees coupled to said pickup tube by means of a swivel joint, thereby allowing said elbow to rotate freely about said pickup tube.

3. The ATM security system of claim 2 further comprising:

a weight affixed to the end of said elbow opposite said swivel joint, thereby rotating the weighted end of said elbow downward, upon said ATM device becoming oriented horizontally.

4. The ATM security system of claim 1 further comprising a plurality of bushings inserted in said holes of said banknote cassette.

5. The ATM security system of claim 1 wherein each said ink guide is comprised of a flat head, an opening in said head, and a nozzle affixed to said head at said opening, said nozzle protruding outside said manifold.

6. The ATM security system of claim 5 further comprising an o-ring disposed about each said nozzle in proximity to said head, said o-ring maintained within said manifold.

7. The ATM security system of claim 5 wherein each nozzle terminates in a discharge end having a beveled surface.

8. The ATM security system of claim 7 wherein said beveled surface contains an annular notch for receiving an o-ring.

9. The ATM security system of claim 1 wherein each said ink guide is comprised of a funnel-shaped head, an opening in said head, and a nozzle affixed to said head at said opening, said nozzle protruding outside said manifold.

10. The ATM security system of claim 9 further comprising an o-ring disposed about each said nozzle in proximity to said head, said o-ring maintained within said manifold.

11. The ATM security system of claim 9 wherein each nozzle terminates in a discharge end having a beveled surface.

12. The ATM security system of claim 11 wherein said beveled surface contains an annular notch for receiving an o-ring therein.

* * * * *